US006099414A

United States Patent [19]

Kusano et al.

[11] Patent Number: 6,099,414

[45] Date of Patent: Aug. 8, 2000

[54] GOLF CLUB HEAD AND METHOD FOR PRODUCING THE SAME

[75] Inventors: Akihiko Kusano; Seiichi Soeda; Masaya Fukuda; Shigeru Chino, all of Tokyo; Takamitsu Takebayashi, Musashino; Kenichi Miyazawa, Tokyo; Etsuji Kakimoto, Chikushino, all of Japan

[73] Assignees: Nippon Steel Corporation; Fourteen Co., Ltd, both of Tokyo; Asahi Kasei Kogyo Kabushiki Kaisha, Osaka, all of Japan

[21] Appl. No.: 09/077,348

[22] PCT Filed: Sep. 24, 1997

[86] PCT No.: PCT/JP97/03368

§ 371 Date: May 26, 1998

§ 102(e) Date: May 26, 1998

[30] Foreign Application Priority Data

Jun. 27, 1996 [JP] Japan ..... 8-256443
Apr. 7, 1997 [JP] Japan ..... 9-88552

[51] Int. Cl.[7] ..... A63B 53/04

[52] U.S. Cl. ..... 473/342; 473/345; 473/349

[58] Field of Search ..... 473/334, 342, 473/345, 349, 350

[56] References Cited

U.S. PATENT DOCUMENTS 5,328,175 7/1994 Yamada ..... 473/345
5,421,577 6/1995 Kobayashi ..... 473/345
5,423,535 6/1995 Shaw ..... 473/342

FOREIGN PATENT DOCUMENTS 60-171055 9/1985 Japan .
5-277215 10/1993 Japan .
6-26634 4/1994 Japan .
6-165843 6/1994 Japan .
6-182006 7/1994 Japan .
6-246021 9/1994 Japan .
7-222830 8/1995 Japan .

*Primary Examiner*—Jeanette Chapman
*Assistant Examiner*—Stephen L. Blau
*Attorney, Agent, or Firm*—Kenyon & Kenyon

[57] ABSTRACT

The present invention provides a golf club head comprising: a face section made of a low specific gravity metal not higher than 5; and a back face section made of a clad material in which the low specific gravity metal and a high specific gravity metal not lower than 7 are metallurgically bonded to each other in advance, wherein the low specific gravity metal of the face section and the low specific gravity metal of the clad material are integrally joined to each other by welding so as to form a club head. In this case, the methods of welding of TIG, plasma arc and laser beams are used in which a U-shaped and/or V-shaped groove is formed. In this golf club head, it is possible to improve the mechanical strength of the joint portion, and it is also possible to produce the golf club head in a short period of time. Since the depth of the center of gravity is large and the center of gravity is lowered so that the moment of inertia can be enhanced, it is possible to provide a golf club head which can be easily swung by a golfer to get distance and a producing method therefor.

14 Claims, 8 Drawing Sheets

GOLF CLUB HEAD AND METHOD FOR PRODUCING THE SAME

TECHNICAL FIELD

The present invention relates to a golf club head. More particularly, the present invention relates to a golf club head made of metals dissimilar to each other and characterized in that: the bonding strength is high; the center of gravity is located at a low position in the club head; the depth of the center of gravity is located at a deep position in the club head; and a range in which the sweet spot is located can be extended.

BACKGROUND ART

Iron golf clubs are well known which are made of a composite material composed of a low specific gravity metal such as titanium or titanium alloy, and a high specific gravity metal such as plain steel or stainless steel.

A golf club head made of a composite material, in which a low specific gravity metal and a high specific gravity metal are bonded to each other, is characterized in that the entire mass of the club head can be reduced. Therefore, it is possible to provide a design thereof with the following advantages.

(1) While the weight of the golf club head is provided with the same value, the size of the club head can be increased.

(2) It is possible to locate the center of gravity at a position which is low with respect to the sole of the golf club head.

(3) It is possible to increase the depth of the center of gravity from the face outer of the golf club head.

(4) It is possible to extend a range in which the sweet spot is located.

However, usually, it is difficult to bond a low specific gravity metal and a high specific gravity metal so as to bond these two types of metals by melting, fusing such as welding. Therefore, the following methods can be adopted. One is a method in which a recess is formed in a portion of the club head and the pieces of metal, which are different from each other, are made to adhere to each other by a bonding agent in the recess (Japanese Unexamined Patent Publication (Kokai) No. 6-165843). The other is a method in which the pieces of metals are press-fitted into the recess so that the pieces of metal can be mechanically engaged with each other (Japanese Unexamined Patent Publication (Kokai) Nos. 6-182006 and 6-246021). However, the following problems may be encountered in the above methods.

First, when pieces of metal, which are different from each other, are joined by bonding agent, the following problems may be encountered. (1) Since the joining strength is low, there is a possibility that the joining surfaces are separated when an impact force is repeatedly applied to the club head face in the case of hitting golf balls. (2) When the golf club is heated after the completion of adhesion, the joined surfaces are separated by the action of heat. Therefore, it is impossible to conduct thermal working on the club head after the completion of adhesion. (3) A bonding agent applied to the club head is deteriorated by the action of heat generated in the working of polishing the club head. Accordingly, it is necessary to suppress the generation of heat in the prudent working of polishing. As a result, it is difficult to conduct polishing in a short period of time, and the working cost is increased. (4) In order to solve the above problems, there is a method for using a pin or the like to fix the pieces of metals. However, this method requires complicated work, and the working cost is increased.

Secondly, when the mechanical engaging means for joining the pieces of metals such as press-fitting is adopted, the engaging portion is loosened in a high temperature environment in summer due to a difference in the physical properties of the material of the club head body and the material of the club face, for example, due to a difference in the characteristics of thermal expansion. Accordingly, there is a possibility that the pieces of metal are disconnected from each other. For the above reasons, the usable combination of metals is restricted.

On the other hand, there is proposed a method in which a composite material is made by means of explosive-welding so that different metals can be metallurgically bonded to each other and thus obtained composite material is subjected to forging so as to form it into a predetermined shape (Japanese Examined Patent Publication (Kokoku) No. 6-26634). When composite material is made by means of explosive-welding and the shape of a club head is formed by forging as described above, it is possible to solve the above problems caused when composite material is made by means of joining by bonding agent and engaging, however, the following different problems may be encountered.

Concerning the method of forging, there are provided a hot forging method and a cold forging method. (1) In the hot forging method, carbon and nitrogen are diffused on the bonding interface in the process of heating. Therefore, carbide and nitride are generated on the bonding interface, and the bonding strength is lowered. (2) In the cold forging method, due to a difference in the plastic deformability between both metals to be bonded, there exists a work strain on the bonding interface in the process of forging. When this work strain is intense, interface separation may be caused by the working and the bonding strength may become very unstable. For example, when pure titanium is used as a low specific gravity metal and stainless steel is used as a high specific gravity metal, the bonding strength obtained by this method is locally deteriorated and the bonding surface is separated by the impact force repeatedly applied when golf balls are hit by this club head. (3) Concerning the method of forging conducted on metals different from each other, it is possible to form the metals into a predetermined shape either by the hot forging method or the cold forging method. However, due to a difference in the plastic deformability between both metals to be bonded, it is difficult to conduct forming while the distribution of weight is kept constant. Therefore, it is necessary to prudently adjust the balance of weight in the process of polishing, which takes time and the working cost is increased.

Further, when different metals are bonded to each other in such a manner that a low specific gravity metal is arranged on the front face side of the club head including the club face and that a high specific gravity metal is arranged on the back face side of the club head, it is possible to provide a club head, the depth of the center of gravity of which is increased and the sweet spot range of which is extended. However, when the depth of the center of gravity is increased as required, there is a problem that the thickness of the club head is increased, and the weight of the club head becomes excessive.

SUMMARY OF THE INVENTION

As described above, in the case of a conventional golf club, the club head of which is composed of composite material made of different metals having different specific gravity, since it is difficult to bond the different metals by melting and fusing, it must rely on joining the different metals by means of a bonding agent or mechanical engagement. When the above means of a bonding agent or mechanical engagement is adopted, there is a possibility that the joined surfaces are separated by a lapse of time or a change in the environment. Even when the different metals are previously made into a composite material and subjected to forging so as to form the composite material into a predetermined shape, the bonding strength on the joint surface is deteriorated while forging. For the above reasons, the bonding strength of the bonding portion of the different metals is low, and there is a possibility that the bonded surfaces are separated when the golf club is used. Accordingly, the golf club cannot be used without anxiety.

Further, only when the different metals, the specific gravities of which are different, are compounded, it is impossible to increase the depth of the center of gravity to the required amount.

Therefore, it is an object of the present invention to provide a golf club head and a method for producing the same characterized in that: the bonding strength in the golf club head is improved; working of the club head can be done in a short period of time; a low center of gravity and the large depth of the center of gravity can be realized; and thus the moment of inertia is increased so that the golf club can be easily swung without anxiety, and it is possible to get distance with a high trajectory and the direction of a ball hit by the golf club can be stabilized.

In order to accomplish the above objects, the present invention is summarized as follows.

(1) A golf club head comprising: a face section made of a metal of low specific gravity not higher than 5; and a back face section made of a clad material in which the metal of low specific gravity and a metal of high specific gravity not lower than 7 are metallurgically bonded to each other beforehand, wherein the metal of low specific gravity of the face section and the metal of low specific gravity of the clad material are integrally joined to each other by welding so as to form a club head.

(2) A golf club head comprising: a face section made of a metal of low specific gravity not higher than 5; and a back face section, a portion of which is made of a clad material in which a metal of low specific gravity of the same type as that of the face section and a metal of high specific gravity not lower than 7 are metallurgically bonded to each other beforehand, wherein the metal of high specific gravity is arranged outside the back face section, and the metal of low specific gravity of the face section and the metal of low specific gravity of the composite material of the back face section are integrally bonded to each other so as to form a club head.

(3) A golf club head according to item (1) or (2), wherein the clad material is composed of a plate-shaped composite material made of metals different from each other which are metallurgically bonded beforehand, the plate-shaped composite material is cut and punched to a predetermined size, and the face section and the clad material are integrally bonded to each other by welding so as to form a club head.

(4) A golf club head according to item (1), (2) or (3), wherein the face section and the clad material are cut and polished so as to form a club head after they have been integrally bonded to each other by welding.

(5) A golf club head according to any one of items (1) to (4), wherein a cavity is formed between the face section and the back face section.

(6) A golf club head comprising: a main body of the head made of a metal of low specific gravity not higher than 5; and a sole section of the head made of a composite material composed of metals different from each other in which the same metal of low specific gravity as that of the main body of the head and a metal of a specific gravity not lower than 7 are metallurgically bonded to each other, wherein the metal of low specific gravity of the main body of the head and the metal of low specific gravity of the composite material of the sole section are integrally joined to each other by welding so as to form a club head.

(7) A golf club head characterized in that: the upper stage portion and the middle stage portion are made of a metal of low specific gravity not higher than 5, the lower stage portion is made of a metal of high specific gravity not lower than 7; the metal of low specific gravity in the middle stage portion and the metal of high specific gravity in the lower stage portion are metallurgically bonded to each other beforehand so as to be formed into a composite material of different metals; and the metal of low specific gravity in the upper stage portion and the metal of low specific gravity in the middle stage portion are integrally joined to each other by welding so as to be formed into a club head.

(8) A golf club head according to item (7), wherein the toe section and/or the hosel section is made of a metal of high specific gravity not lower than 7 and is metallurgically bonded at least to the metal of high specific gravity of the lower stage.

(9) A golf club head according to item (7,) wherein the hosel section is composed of an intermediate member including a lower stage portion made of a metal of low specific gravity not higher than 5 and upper stage portion made of a metal of high specific gravity not lower than 7 which is metallurgically bonded in advance, the lower stage portion is welded to the metal of low specific gravity of the upper stage portion of the club head, and the upper stage portion is welded to the stick made of a metal of high specific gravity so as to form the hosel section.

(10) A golf club head according to any one of items (1) to (4), (6), (7) and (9), wherein welding is conducted by means of TIG, plasma arc or laser beams in which a U-shaped and/or V-shaped groove is formed on the surface to be joined.

(11) A golf club head according to any one of items (1) to (7) and (9), wherein, the metal of low specific gravity not higher than 5 contains at least one of titanium, aluminum, magnesium, beryllium, silicon, strontium, vanadium, zirconium, tellurium and antimony, and the residual is inevitable impurities.

(12) A golf club head according to item (1), (2), (6), or (7), wherein, the metal of high specific gravity not lower than 7 contains at least one of iron, copper, silver, platinum, gold, niobium, nickel, chromium, manganese, cobalt, molybdenum, tantalum and tungsten, and the residual is inevitable impurities.

(13) A method of producing a golf club head comprising the step of cutting a piece of composite material, in which a metal of low specific gravity not higher than 5 and a metal of high specific gravity not lower than 7 are metallurgically bonded to each other beforehand, is cut to be formed into a club head so that a main portion of the upper stage of the head can be the metal of low specific gravity and the lower stage portion including the sole portion can be the metal of high specific gravity.

(14) A method of producing a golf club head according to item (1), (2), (6), (7) or (13), wherein the metallurgical bonding method is an explosive-welding method.

BRIEF DESCRIPTION OF THE DRAWINGS

FIG. 1(*b*) is a cross-sectional view taken on line A—A in FIG. 1(*a*).

FIG. 2(*b*) is a cross-sectional view taken on line B—B in FIG. 2(*a*).

FIG. 3(*b*) is a cross-sectional view taken on line C—C in FIG. 3(*a*).

FIG. 4(*b*) is a cross-sectional view taken on line D—D in FIG. 4(*a*).

FIG. 7(*b*) is a front view of the club face of the iron club head of the present invention.

BEST MODE FOR CARRYING OUT THE INVENTION

Figure 1B:
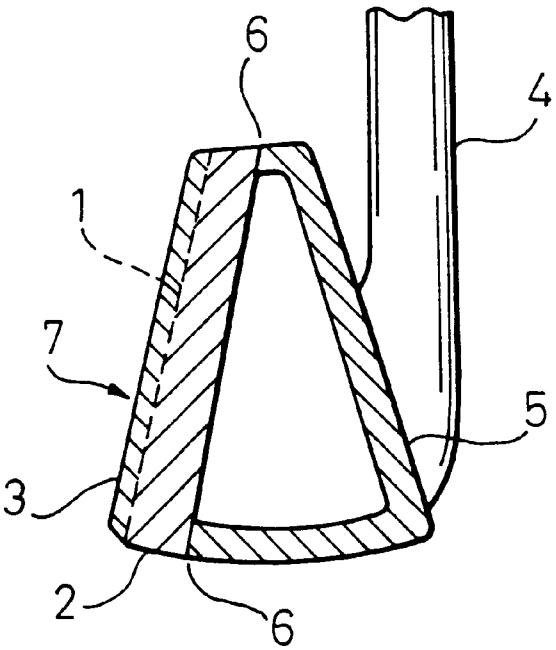
FIG. 1(*a*) is a front view of the iron club head of Example 1 of the present invention.

The first characteristic of the present invention is that the face section of the club head is made of a low specific gravity metal and the back face section of the club head is made of a clad material which is composed of a composite material of different metals in which the same metal of low specific gravity as that used in the face portion and a high specific gravity metal are metallurgically bonded to each other beforehand. In this case, the composite material of different metals may be made in the form of a plate-shape and cut into a predetermined size when required. Alternatively, the low specific gravity metal in the face section and the low specific gravity metal of composite material in the back face section may be joined to each other by means of plasma welding while U-shaped grooves are formed for welding. After welding, it may be cut into a predetermined size when required. In this connection, when plasma welding is applied to the production of the club head of the present invention, a current of plasma, the energy density of which is high, is utilized. Therefore, an area of a melted portion to be welded can be made small and a depth of the melted portion to be welded can be increased. Although the conventional TIG welding process is disadvantageous in that an area of the heat affected zone is large, it is possible to narrow the area of the heat affected zone by the plasma welding process applied to the present invention.

According to the present invention, it is possible to produce a golf club head in which a cavity is formed between the face section and the back face section when required. Further, according to the present invention, it is possible to provide a high bonding strength without deteriorating the metallurgical bonding strength of different metals. Furthermore, it is possible to sufficiently increase the depth of the center of gravity. Therefore, it is possible to provide a golf club head, the characteristic of which is so excellent that the golf club head can be used over a long period of time with a good feeling when it is used.

Examples of usable metals of low specific gravity are: titanium, aluminum, magnesium, beryllium, silicon and strontium, the specific gravities of which are not higher than 5. Alternatively, it is possible to use an alloy in which at least one of them is contained. Further, it is possible to use an alloy, the specific gravity of which is not higher than 5, in which at least one of vanadium, zirconium, tellurium and antimony is contained. Especially, the specific strength of titanium or titanium alloy is high, that is, titanium or titanium alloy is light, and the resiliency of titanium or titanium alloy is high. Accordingly, it is preferable to use titanium or titanium alloy for the purpose of getting distance.

Examples of usable metals of high specific gravity are: iron, copper, silver, platinum, gold, niobium, nickel, chromium, manganese, cobalt, molybdenum, tantalum and tungsten. Also, it is possible to use an alloy containing at least one of the above metals. From the viewpoint of procuring material easily, working the material smoothly and reducing the cost, it is preferable to use steel. In addition to that, from the viewpoint of anti-corrosion property, it is preferable to use stainless steel. Further, in order to lower the position of the center of gravity and furthermore in order to color the club head, it is preferable to use a metal of high specific gravity such as copper, copper alloy, tantalum, tungsten or tungsten alloy.

As mentioned above the low specific gravity metal and the high specific gravity metal, which are different from each other, are metallurgically bonded to each other beforehand so as to form a clad material which is a composite material. There are various methods of bonding the different metals metallurgically. For example, when titanium and stainless steel are joined to each other by a conventional melting and welding method, a hard fragile intermetallic compound is generated on the joining interface of both metals. Therefore, it is impossible to ensure the necessary bonding performance. When a resistance welding method, in which metals are joined by diffusion, is adopted, it is possible to join even the above different metals from the theoretical viewpoint. However, when a force given to the metals in the process of welding is weak, it is impossible to obtain a sufficiently high bonding strength. That is, when the force is given by a conventional resistance welding machine, it is impossible to obtain a stable bonding performance (bonding strength).

A metallurgical bonding to bond the different metals conducted in the present invention is a solid phase bonding, and the present invention aims at a stable bonding method. In order to satisfy the above object, there are provided an explosive-welding method and a hot or cold rolling method.

According to the explosive-welding method, metals are made to collide with each other by the energy of an explosion, and the metals can be instantaneously bonded to each other, at low temperatures, by the high pressure generated in the process of collision and it is unnecessary to heat the materials to be bonded. The characteristic of the explosive-welding method is described as follows. A wave pattern is generally formed on the bonding interface and the bonding strength of the composite material bonded by explosive-welding method is higher than that of the composite material which is bonded when the metals are heated in the production process. Therefore, the explosive-welding method is best among the metallurgical bonding methods.

Next to the explosive-welding method, the rolling bonding method is the second-best method to obtain a stable bonding. In the rolling bonding method, bonding is conducted in the same manner as that of the resistance welding method. However, in the rolling bonding method, metals are bonded in diffusion while a remarkably strong force is given to the metals to be bonded. Accordingly, it is possible to ensure a high bonding performance. Further, it is possible to adopt a friction welding method and a diffusion junction method which is conducted under a high reduction.

In the above bonding process, a method or the like in which an intermediate layer is inserted between the metals different from each other so that the diffusion of carbon and nitrogen on the bonding interface can be prevented and thereby the generation of carbide, nitride and intermetallic compound can be prevented to ensure the bonding strength can be adopted.

Figure 1A:
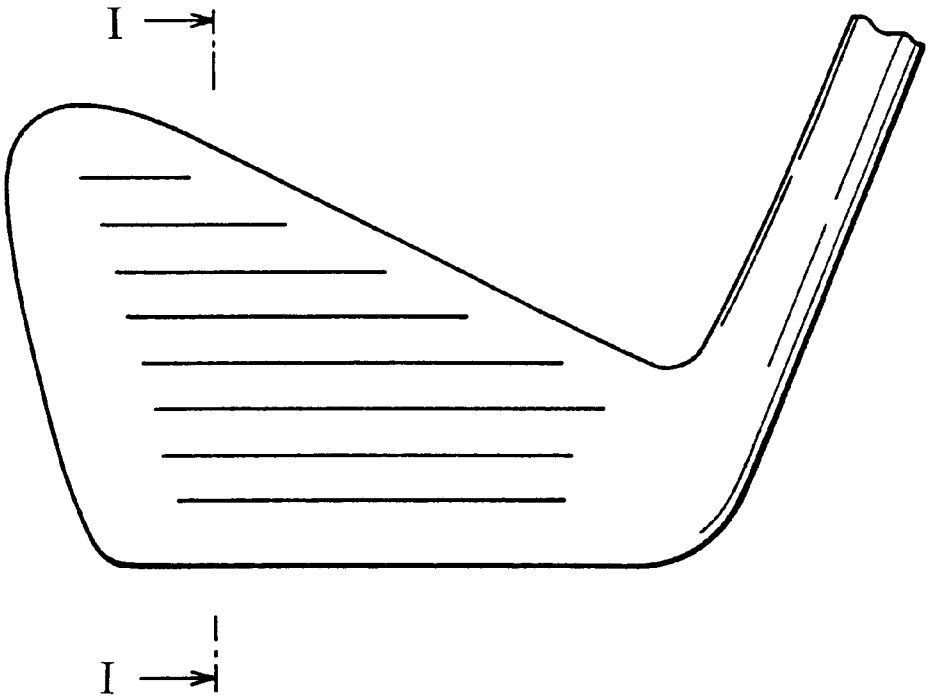

As an example is shown in FIGS. 1(*a*) and 1(*b*), the club head may be composed as follows. The face section 5 of the club head is made of a low specific gravity metal, and the back face section 7 is made of a composite material of different metals in which the low specific gravity metal 2 and the high specific gravity metal 3 are metallurgically bonded to each other beforehand, and the low specific gravity metal 5 in the face section is joined to the low specific gravity metal 2 of the composite material in the back face section by means of welding 6. A space may be formed between the low specific gravity metal 5 in the face section and the composite material in the back face section 7.

Figure 3B:
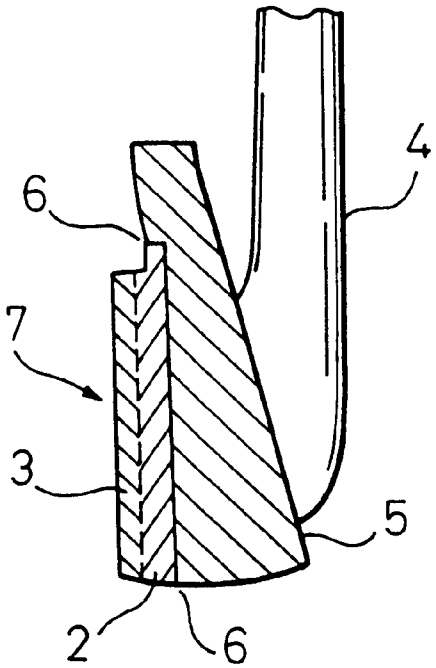
FIG. 3(*a*) is a front view of the iron club head of Example 3 of the present invention.
Figure 3A:
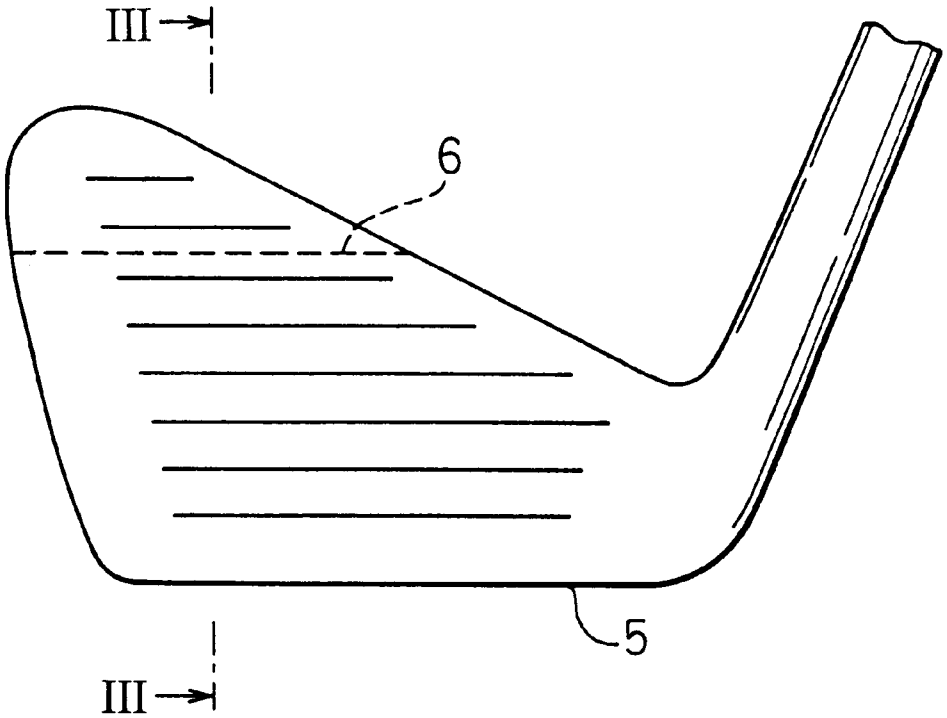

The face section, which is made of a low specific gravity metal, may be formed into a profile by casting or forging, and the profile includes a hosel section 4 if necessary. The composite material in which the low specific gravity metal 2 and the high specific gravity metal 3 are metallurgically bonded to each other is arranged on the back face side so that the space can be formed between the low specific gravity metal 5 in the face section and the composite material in the back face section, and the high specific gravity metal 3 is arranged outside the back face section. Although the low specific gravity metal 5 in the face section is welded to the low specific gravity metal 2 of the composite material in the back face section, welding is conducted between the same metals. Therefore, welding can be easily performed without causing any defect. Since the high specific gravity metal 3 is arranged outside the back face section so that the space can be formed inside the club head, the position of the center of gravity is distant from the club face. Therefore, it is possible to provide a club head, the depth of the center of gravity of which is larger than the depth of any conventional club head. As shown in FIGS. 3(*a*) and 3(*b*), the club head may be composed in such a manner that no cavity is formed inside the club head. Even in the case of the above club head structure, it is possible to manufacture a club head, the depth of the center of gravity of which is large.

Further, the present invention provides a golf club head comprising: a main head body made of a low specific gravity metal; and a sole section composed of a composite material of different metals, wherein the low specific gravity metal of the main head body is welded to the low specific gravity metal of the composite material in the sole section. Therefore, the club head of the present invention can be easily produced, and it is possible to ensure a high bonding strength without deteriorating the metallurgical bonding strength of the different metals. Further, it is possible to arrange the center of gravity at a low position, so that a golfer can have a good feeling when he swings the golf club, and furthermore the durability of the club head is high.

Also, the present invention provides a golf club head characterized in that: the upper stage portion and the middle stage portion are made of a low specific gravity metal, the lower stage portion is made of a high specific gravity metal; the low specific gravity metal in the middle stage portion and the high specific gravity metal in the lower stage portion are metallurgically bonded to each other beforehand and formed into a composite material of different metals; and the low specific gravity metal in the upper stage portion and the low specific gravity metal in the middle stage portion are integrally joined to each other by welding so as to be formed into a club head. Therefore, the club head of the present invention can be easily produced, and it is possible to ensure a high bonding strength without deteriorating the metallurgical bonding strength of the different metals. Further, a golfer can have a good feeling when he swings the golf club, and furthermore the durability of the club head is high.

The method of producing the club head of the present invention will be specifically explained below.

Figure 5:
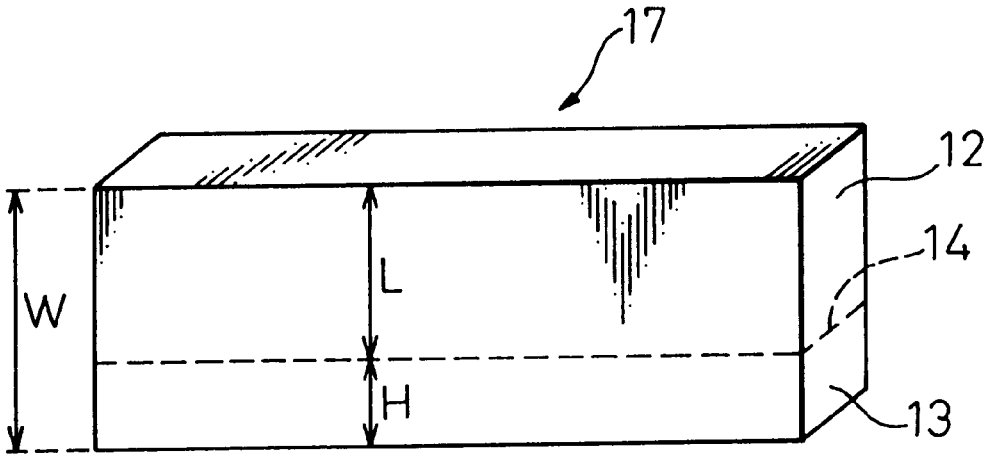
FIG. 5 is a structural view showing a raw material of a block of composite material used for the present invention.

An example of the composite material is shown in FIG. 5. The low specific gravity metal 12 is arranged in the upper stage, and the high specific gravity metal 13 is arranged in the lower stage. These metals 12, 13 are bonded to each other by the bonding section 14. The distribution of mass to the upper metal 12 and the lower metal 13 and the volumetric ratio can be arbitrarily determined in accordance with the number of an objective golf club, the profile of the club head and the designed mass. An example of the size of the composite material shown in the drawing is shown as follows. Width W of the composite material is 50 to 60 mm, and a ratio of width H of the lower stage metal 13 to width L of the upper stage metal 12 is approximately 1:3 to 5. It should be understood that the present invention is not limited to the above specific example.

The composite material 17 may be cut out from a large sheet of the composite material. Alternatively, the composite material 17 may be directly made into a composite material block. The composite material is formed into a profile of the club head by means of cutting and punching. Cutting can be conducted by a well known means such as an NC lathe. In this case, cutting is conducted so that the primary portion on the upper stage side can be composed of a low specific gravity metal and the lower stage portion including the sole portion can be composed of a high specific gravity metal. After the completion of cutting, it is roughly polished so as to adjust the weight, and at the same time, the hosel portion is formed by cutting and polishing. In this way, the intermediate material of the club head is formed.

Figure 9:
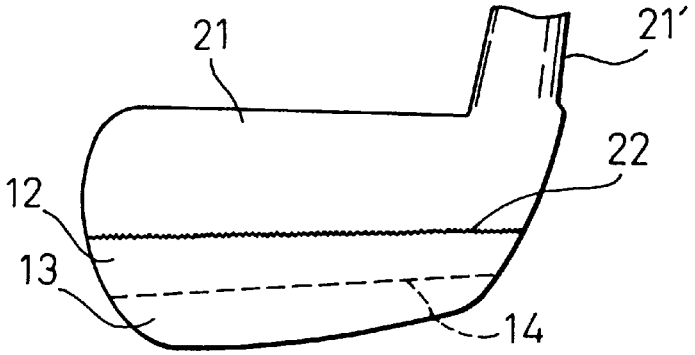
FIG. 9 is a structural view of the iron club head of Example 8 of the present invention.

As an example is shown in FIG. 9, the club head can be composed of three stages. This three stage structure is described as follows. The upper stage portion 21 and the middle stage portion 12 of the club head are made of low specific gravity metal, and the lower stage portion 13 is made of high specific gravity metal. The low specific gravity metal in the middle stage portion 12 and the high specific gravity metal in the lower stage portion 13 are metallurgically bonded to each other so that the composite material of different metals is formed, and the low specific gravity metal in the upper stage portion 21 and the low specific gravity metal in the middle stage portion 12 are welded to each other. The upper stage portion made of low specific gravity metal can be easily formed into a predetermined profile by casting or forging. The composite material, in which the low specific gravity metal in the middle stage portion and the high specific gravity metal in the lower stage portion are metallurgically bonded to each other, can be formed into an approximately rectangular member as shown in FIG. 9. Therefore, the material can be effectively used. This composite material member can be lightly deformed by press forming in accordance with a curve of the sole portion of the club head. Different from hot forging or cold forging in which a heavy plastic working is conducted, in the case of a light press bending, there is no possibility of deterioration of the bonding strength caused due to the interface separation. Since the same metals are joined to each other when the upper stage portion and the lower stage portion are welded, welding can be conducted without any defect.

Concerning the welding conducted in the process of producing the above club head, it is possible to apply the method of TIG (tungsten inert gas) welding, the method of plasma arc welding or the method of laser beam welding in which a high intensity of energy is used. On the joining surface, a U-shaped or a V-shaped groove may be singly arranged, or a U-shaped and a V-shaped groove may be arranged being combined with each other.

Of course, the above club head of the present invention is formed into an iron club head. However, since the above club head of the present invention is characterized in that the position of its gravity center is low and the depth of its gravity center is large, when the above characteristic of the club head is utilized, the club head can formed into a club head having both characteristics of an iron club and a wood club, which is not limited to the category of the conventional iron club.

Figure 6:
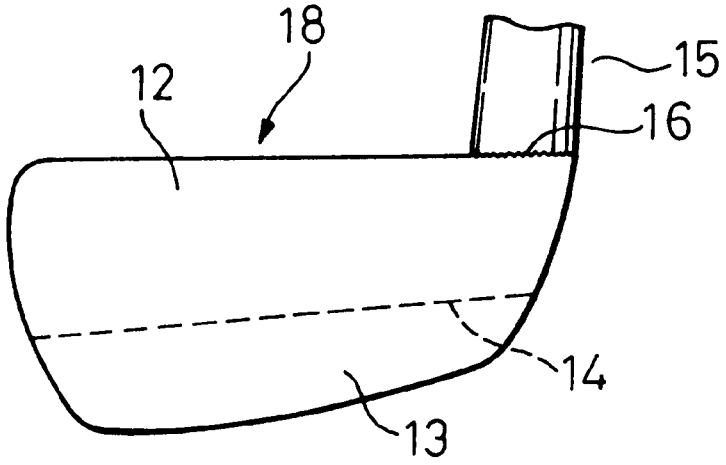
FIG. 6 is a structural view showing the iron club head of Examples 5 and 6 of the present invention.

FIG. 6 is a view showing an outline of the profile of the intermediate material 18 in which the hosel section 15 is joined to the low specific gravity metal 12 in the upper stage at the joined portion 16.

The hosel section may be composed of one body of metal of low specific gravity in the upper stage which is formed by cutting. In this case, it is necessary that the thickness (width L) of the low specific gravity metal in the upper stage is increased in accordance with the length of the hosel section, and further a quantity of the low specific gravity metal in the upper stage to be cut off is increased. Accordingly, as shown in FIG. 6, when the hosel section 15 is joined to the low specific gravity metal 12 in the upper stage by the joint section 16, the hosel section 15 can be easily arranged. Especially when the same metal as the low specific gravity metal in the upper stage is used for the hosel section 15, it is possible to weld the hosel section 15 to the low specific gravity metal in the upper stage. Accordingly, the producing process can be simplified.

Figure 14:
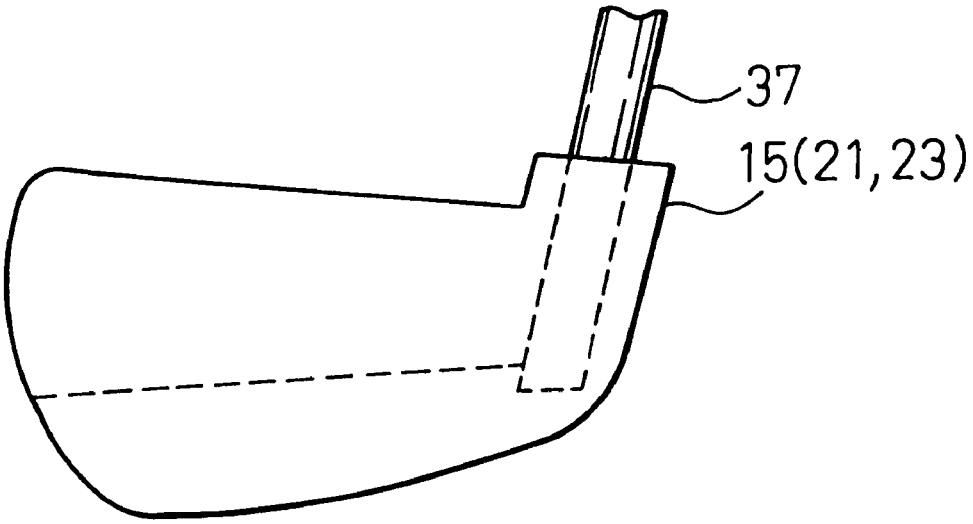
FIG. 14 is a structural view of the iron club head of Example 12 of the present invention.

When the same metal as the low specific gravity metal 12 in the upper stage is used for the hosel section 15, the club head can be formed into the following structure. That is, the intermediate member is composed of a lower portion made of the low specific gravity metal and an upper portion made of the high specific gravity metal which can be metallurgically combined with the low specific gravity metal in the lower portion. The low specific gravity metal in the lower portion is bonded to the low specific gravity metal in the upper stage of the club head, and the high specific gravity metal, which becomes an upper portion of the hosel, is joined to the high specific gravity metal in the upper portion, so that the hosel can be formed as shown in FIG. 14. Due to the foregoing, the same metals can be joined to each other.

On the other hand, when the overall hosel section is made of a high specific gravity metal and joined to the high specific gravity metal of the club head which is the same type metal as the high specific gravity metal of the hosel section, it is possible to increase the moment of inertia. At this time, when the toe section is made of the high specific gravity metal and joined to the high specific gravity metal of the club head which is the same type metal as the metal of the toe section, the position of the center of gravity can be well balanced and the moment of inertia can be further enhanced, and furthermore the golf club can be easily swung by a golfer and it possible to get distance while the trajectory of a ball is kept high. The bonding strength of this club head is high.

Figure 7A:
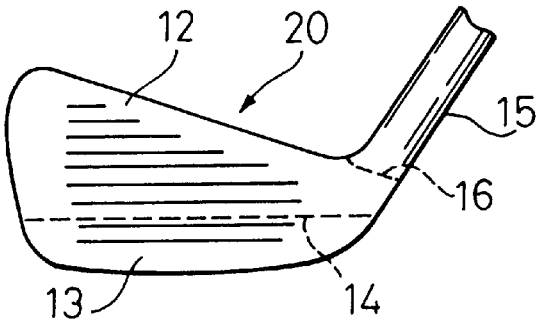
FIG. 7(*a*) is a side view of the club face of the iron club head of the present invention.
Figure 7B:
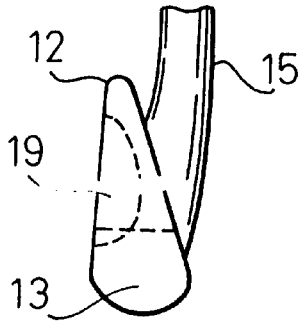

After that, the club head is further polished, and the weight and the balance are accurately adjusted. In this way, the product 20 shown in FIGS. 7(*a*) and 7(*b*) can be provided. In this case, FIG. 7(*a*) is a side view of the club face, and FIG. 7(*b*) is a front view of the club face.

Referring to examples shown in the drawings, various embodiments included in the present invention will be explained in detail. In this connection, the product or the club head produced according to the present invention will be referred to as an iron or an iron club, hereinafter.

EXAMPLES

Example 1

As shown in FIGS. 1(*a*) and 1(*b*), the club head was composed as follows. A composite material block was made by the method of explosive-welding. The overall thickness of the composite material block was 6 mm, the thickness of pure titanium 2 was 4 mm, and the thickness of stainless steel 3 was 2 mm. This composite material block was formed into a profile of the back face section 7. A cast was made of titanium alloy (6A1-4V) in which the hosel section 4 and the face sole section were integrated into one body, and the face section 5 of the cast made of titanium alloy was arranged so that a cavity can be formed between the face section 5 and the composite material member. The titanium member 2 of the composite material was joined to the face section by the method of plasma arc welding in which a U-shaped groove was formed, that is, the same metals were joined to each other at the bonding portion 6, so that the stainless steel 3, which was a high specific gravity metal, could be arranged outside the back face section. In this way, the intermediate material was formed into a profile of the club head. Further, this intermediate material was finished to a final profile by polishing. Then, a shaft and a grip were attached to the club head, so that an iron golf club referred to as a No. 4 iron was produced.

In this club head, the depth from the face to the center of gravity was 8 mm. Since the depth from the face to the center of gravity was approximately 2.5 to 3 mm in the case of a conventional club head made of a single metal, the club head of the present invention was able to realize the depth of the center of gravity which was impossible to accomplish by the conventional golf club. Due to the foregoing, even when a hitting point of a ball at which the ball is hit by the golf club head deviates from a position immediately above the center of gravity of the club head, the direction of the ball which has been hit by the golf club head can be kept more accurate than the direction of the ball which has been hit by a conventional iron club head.

The durability test of the neck section was conducted on this golf club by a tester as follows. Balls were hit 6000 times at the center of gravity of this golf club head at the speed of 43 m/sec. Also, balls were hit 1000 times at a position distant from the center of gravity of the club head by 15 mm to the toe side at the speed of 43 m/sec, and also balls were hit 1000 times at a position distant from the center of gravity of the club head by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

Example 2

Figure 2B:
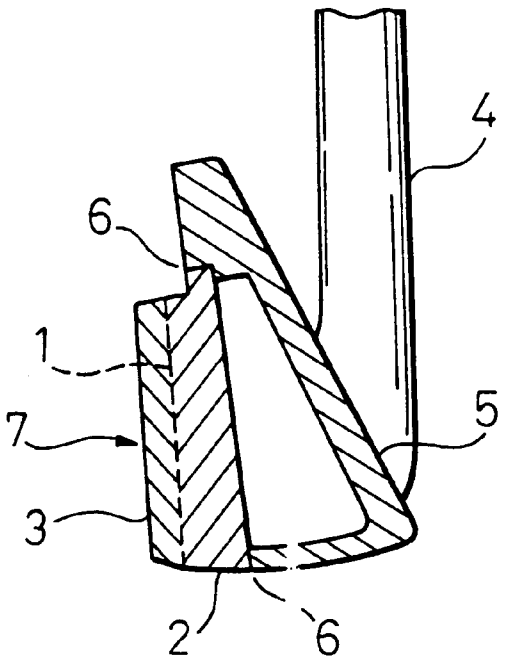
FIG. 2(*a*) is a front view of the iron club head of Example 2 of the present invention.
Figure 2A:
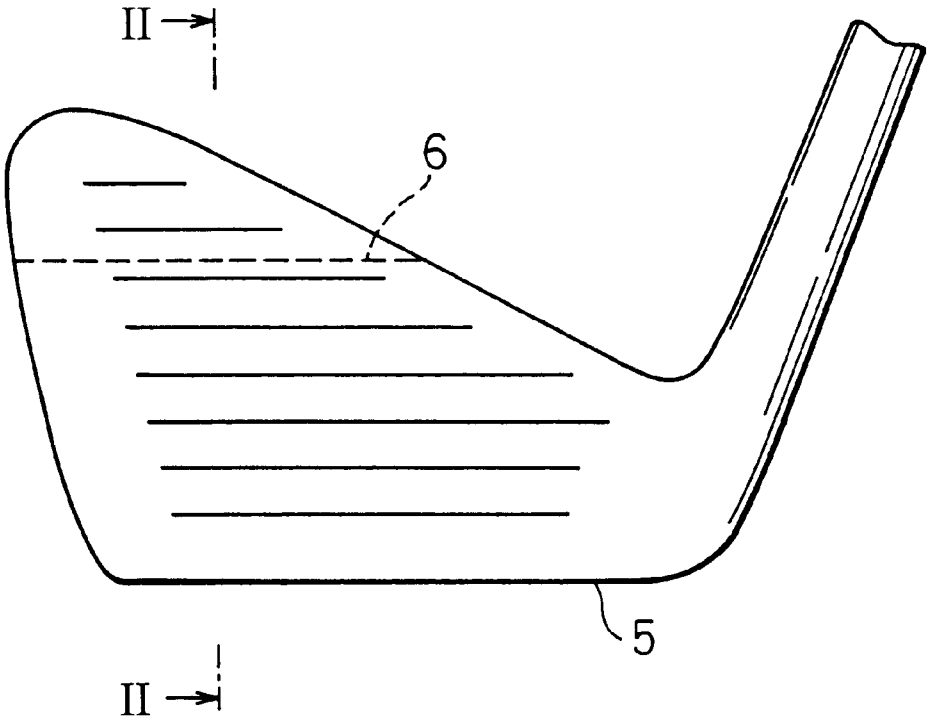

As shown in FIGS. 2(*a*) and 2(*b*), the iron club head of Example 2 was composed as follows. An upper portion of the back face section of the club head of Example 1 was integrally made of a titanium cast together with the face section 5 and the sole section, and the composite material member including the titanium 2 and the stainless steel 3 of the back face section 7 is reduced. While other points of Example 2 were the same as those of Example 1, an iron club head referred to as a No. 4 iron was produced.

Since a portion occupied by the high specific gravity metal was concentrated at a lower portion of the club head compared with the structure of Example 1, it was possible to increase the depth of the center of gravity and it was also possible to lower the center of gravity.

Example 3

As shown in FIGS. 3(*a*) and 3(*b*), the iron club head of Example 3 was composed as follows. The profile of the club head was composed in such a manner that no cavity was formed between the main body 5 of the face section and the composite material 7. While other points of Example 3 were the same as those of Example 2, an iron club head referred to as a No. 9 iron was produced. Since no cavity was formed between the face section and the composite material in Example 3, the depth of the center of gravity was decreased as compared with Example 2, however, as an effect of the composite structure in which the low specific gravity metal and the high specific gravity metal were combined with each other, it was possible to obtain a large depth of the center of gravity compared with a club head made of a single metal. In the club head of this example, the face section was made of a single low specific gravity metal, and the back face section was made of a composite material, and both were welded to each other. As a result of the above welded structure, it was unnecessary to conduct a difficult working such as forging on the composite material. Further, compared with a case in which a club profile was formed by cutting a solid composite material, it was possible to save material and simplify the production process in this example.

Example 4

Figure 4B:
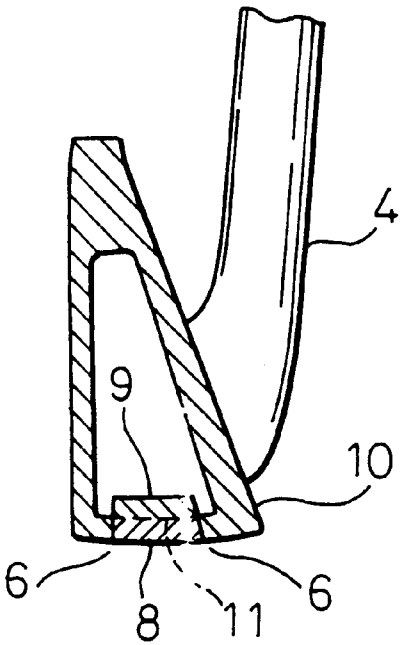
FIG. 4(*a*) is a front view of the iron club head of Example 4 of the present invention.
Figure 4A:
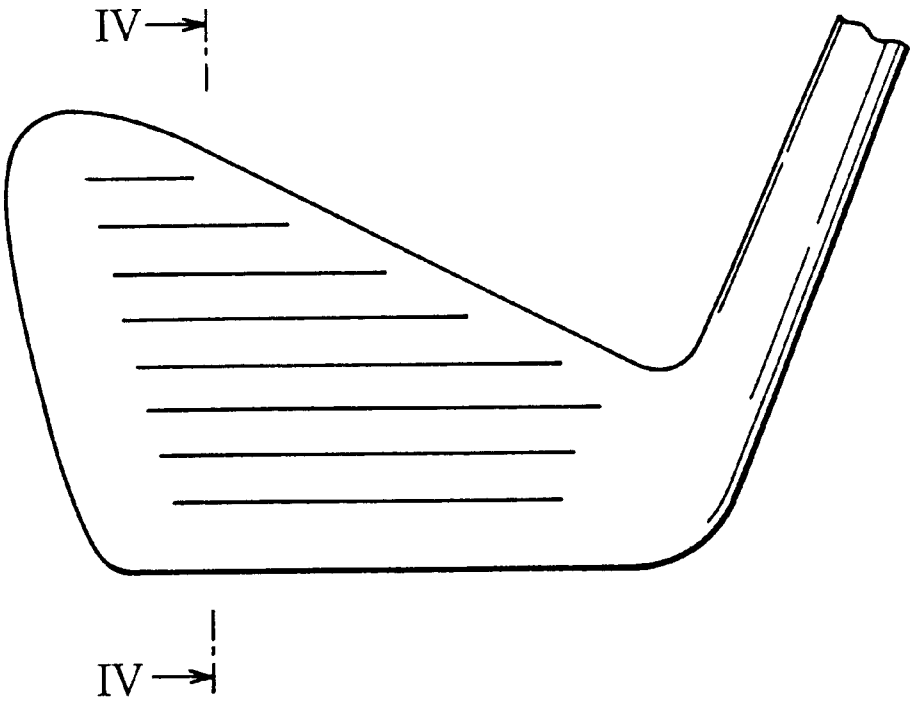

As shown in FIGS. 4(*a*) and 4(*b*), the club head was composed as follows. A composite material block was made by the method of explosive-welding. The overall thickness of the composite material block was 4 mm, the thickness of pure titanium 8 was 2 mm, and the thickness of tungsten alloy 9 was 2 mm. This composite material block was formed into the profile of the sole face. A cast was made of pure titanium in which the hosel section 4 and the main head body 10 were integrated into one body, and the main head body 10 of the cast made of titanium was bonded to the pure titanium member 8 of the composite material by means of TIG welding and plasma arc welding in which a U-shaped groove was formed, that is, the same metals were joined to each other at the joined portion 6. In this way, the intermediate material was formed into a profile of the club head. Then, a shaft and a grip were attached to the club head, so that an iron golf club referred to as a No. 4 iron was produced.

The sole section of this club head is composed of composite material. As a result, this golf club has the following strong points at the same time. One is that the depth of the center of gravity is increased, and the other is that the center of gravity is located at a low position. Therefore, the direction of a ball which has been hit by this golf club can be stabilized.

The durability test of the neck section was conducted on this golf club by a tester as follows. Balls were hit 6000 times at the center of gravity of this golf club head at the speed of 43 m/sec. Also, balls were hit 1000 times at a position distant from the center of gravity of this golf club head by 15 mm to the toe side at the speed of 43 m/sec, and also balls were hit 1000 times at a position distant from the center of gravity by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

Example 5

As shown in FIG. 5, the composite material block 17 was manufactured in such a manner that pure titanium 12 TP340 (JIS H4600 (1993) "Titanium Sheets, Plates and Strip"), which is a low specific gravity metal, and stainless steel 13 SUS 316L (JIS G4304 (1991) "Hot Rolled Stainless Steel Sheets and Plates", which is a high specific gravity metal, were bonded to each other by the method of explosive-welding at the bonding boundary 14. The total width (W) of this composite material 17 was 55 mm. In this case, the width (L) of the pure titanium 12 was 40 mm, and the width (H) of the stainless steel 13 was 15 mm. The pure titanium 12 and the stainless steel 13 were metallurgically bonded to each other at the bonding boundary 14. This material block was cut into an intermediate shape 18 of the iron club head as shown in FIG. 6 so that the pure titanium 12 could be a primary portion of the upper stage and the stainless steel 13 could be a lower stage portion including the sole section. A titanium rod 15 (rod of TP340, the outer diameter of which was 12 mm), which was produced differently, was joined to the material block of the intermediate shape 18 by the methods of TIG welding and plasma arc welding in which a U-shaped groove was formed at the joined boundary 16. After that, polishing was conducted, and the final product shape 20 shown in FIGS. 7(*a*) and 7(*b*) was obtained in which the center of gravity was located at a position distant from the sole surface by 13 mm. Then a shaft was attached to the hosel 15, and a grip was fixed to an upper portion of the shaft. In this way, a cavity type long iron golf club, usually referred to as a No. 2 iron, was manufactured. A ratio of the weight of stainless steel to the weight of pure titanium in the product club head was approximately 1:6.5.

After the completion of manufacture of the iron club, the durability test of the neck section was conducted on this golf club by a tester as follows. Balls were hit 6000 times at the center (sweet spot) of gravity of this golf club head at the speed of 43 m/sec. Also, balls were hit 1000 times at a position distant from the center of gravity of this golf club head by 15 mm to the toe side at the speed of 43 m/sec, and also balls were hit 1000 times at a position distant from the center of gravity by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

The joining strength of the joint obtained by the method of was measured for the joint of this example in which the different metals were bonded to each other. In the method of the present invention, after the bonding member of the different metals had been machined, in the comparative example, after the completion of forging, the bonding strength was measured at five measuring points on the joint surface of, and the lowest value was defined as the bonding strength. The above measurement was conducted on five examples (No. 1 to 5) according to the method of the Shearing Strength Test stipulated by JIS G0601. The result of the test is shown on Table 1 below.

TABLE 1

| | No. 1 | No. 2 | No. 3 | No. 4 | ($N/mm^2$) No. 5 |
|---|---|---|---|---|---|
| Example of Invention | 332 | 365 | 364 | 381 | 350 |
| Comparative Example | 227 | 284 | 259 | 233 | 241 |

Example 6

The same composite material block 17 as that shown in FIG. 5 was made by the hot rolling method. The overall width of this composite material was 55 mm. In this case, the width of the pure titanium 12 was 40 mm, and the width of the stainless steel 13 was 15 mm. The pure titanium 12 and the stainless steel 13 were metallurgically bonded to each other at the bonding boundary 14. This material block was directly cut into an intermediate shape of the iron club head as shown in FIG. 6 so that the pure titanium 12 could be a primary portion of the upper stage of the club head and the stainless steel 13 could be a lower stage portion including the sole section. A titanium rod 15 (the outer diameter of which was 12 mm), which was produced differently, was joined at a hosel attaching position of the material block by the methods of TIG welding and plasma arc welding in which a U-shaped groove was formed. After that, polishing was conducted, and the final product shape, shown in FIG. 7, was obtained in which the center of gravity was located at a position distant from the sole surface by 13 mm. Then a shaft was attached to the hosel, and a grip was fixed to the shaft. In this way, a cavity type long iron golf club, which is usually referred to as a No. 2 iron, was produced. A ratio of the weight of stainless steel to the weight of pure titanium in the product club head was determined to be the same as that of Example 5.

The durability test of the neck section was conducted on this golf club by a tester in the same manner as that of Example 5. Balls were hit 6000 times at the center of gravity of this golf club head at the speed of 43 m/sec. Also, balls were hit 1000 times at a position distant from the center of gravity of this golf club head by 15 mm to the toe side at the speed of 43 m/sec, and also balls were hit 1000 times at a position distant from the center of gravity by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

Example 7

Figure 8:
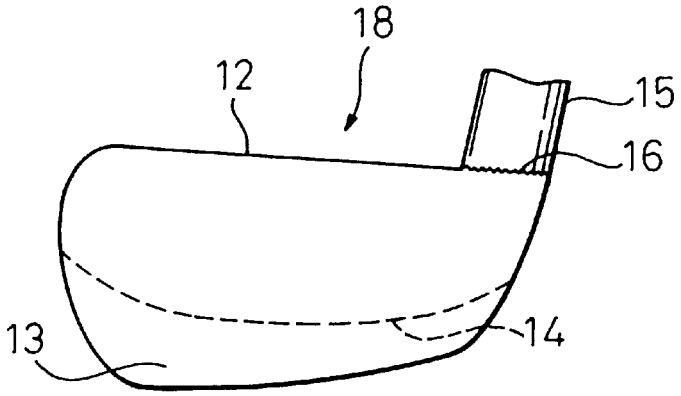
FIG. 8 is a structural view of the iron club head of Example 7 of the present invention.

A piece of pure titanium (TP340), the bonding surface of which was curved into a convex shape, and a piece of stainless steel (SUS316L), the bonding surface of which was curved into a concave shape, were bonded to each other by the method of explosive-welding, so that a composite material block was manufactured. The overall width of the composite material block was 55 mm, and the width of the piece of pure titanium 12 arranged at the center was 40 mm, and the width of the piece of stainless steel 13 was 15 mm. Those pieces were metallurgically bonded to each other at the bonding boundary. This material block was directly cut into an intermediate shape 18 of the iron club head as shown in FIG. 8 so that the pure titanium 12 could be a primary portion of the upper stage and the stainless steel 13 could be a lower stage portion including the sole section. A titanium rod 15 (a rod of TP340, the outer diameter of which was 12 mm), which was produced differently, was joined to the material block of the intermediate shape 18 by the methods of TIG welding and plasma arc welding in which a U-shaped groove was formed. After that, polishing was conducted, and the final product shape was obtained in which the center of gravity was located at a position distant from the sole surface by 13 mm in the same manner as that of Example 5. Then a shaft was attached to the hosel, and a grip was fixed to the shaft. In this way, a cavity type long iron golf club, which is usually referred to as a No. 2 iron, was produced. The ratio of the weight of stainless steel to the weight of pure titanium in the product club head was determined to be approximately 1:6.4.

The durability test of the neck section was conducted on this golf club by a tester. Balls were hit 6000 times at the center of gravity of this golf club head at the speed of 43 m/sec. Also, balls were hit 1000 times at a position distant from the center of gravity of this golf club head by 15 mm to the toe side at the speed of 43 m/sec, and also balls were hit 1000 times at a position distant from the center of gravity by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

Example 8

A composite material block, the overall width of which was 25 mm, the width of pure titanium 12 of which was 10 mm, the width of stainless steel of which was 15 mm, was made by the method of explosive-welding. As shown in FIG.

9, an upper face body 21, which was cast of pure titanium and made differently and integrated with a hosel section 21', was joined to the pure titanium 12 of the composite material by the method of TIG welding and plasma arc welding in which a U-shaped groove was formed, that is, a same metal join 22 was produced. In this way, an intermediate material of a club shape was formed so that the stainless steel 13, which was a metal of high specific gravity, could be arranged on the sole side. Further, this intermediate material was polished and finished into a final shape. Then a shaft was attached to the hosel, and a grip was fixed to the shaft. In this way, a cavity type long iron golf club, which is usually referred to as a No. 3 iron, was produced. The ratio of the weight of stainless steel to the weight of pure titanium in the product club head was determined to be approximately 1:6.6.

The durability test of the neck section was conducted on this golf club by a tester. Balls were hit 6000 times at the center of gravity of this golf club head at the speed of 43 m/sec. Also, balls were hit 1000 times at a position distant from the center of gravity of this golf club head by 15 mm to the toe side at the speed of 43 m/sec, and also balls were hit 1000 times at a position distant from the center of gravity by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

The reason why the above result was obtained in this example is considered to be as follows. In this example, the upper portion 21 of the face was welded to the pure titanium 12 of the composite material on a welding line 22. In this case, the main body of the face was thin, that is, the main body 21 of the face was 5 mm thick, and the titanium 12 of the composite material was thick, that is, the titanium 12 of the composite material was 10 mm thick. Therefore, it was possible to conduct welding even when a small amount of heat was inputted. Accordingly, the joint portion was not affected by the welding heat, so that the bonding strength was not deteriorated.

Example 9

Figure 10:
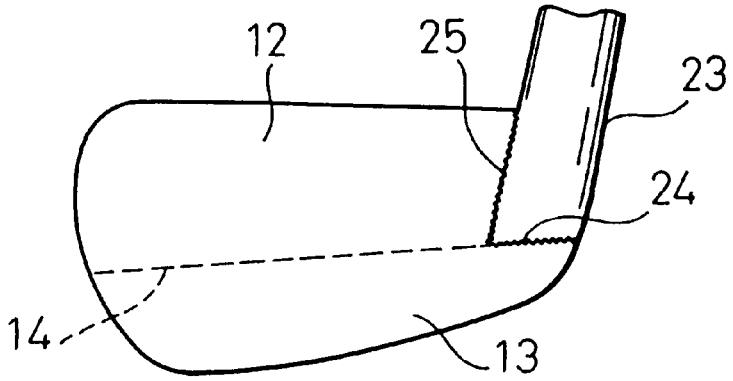
FIG. 10 is a structural view of the iron club head of Example 9 of the present invention.

In FIG. 10, an intermediate composite material block was formed into a club head as follows. In this case, the intermediate composite material block was the same composite material member of Example 5. That is, the overall width was 55 mm, the width of the pure titanium was 40 mm, and the width of the stainless steel was 15 mm, wherein the method of explosive-welding was applied to form the composite material member. A portion of one end of the composite material member on the pure titanium 12 side was cut out, and the composite material member was roughly machined into a shape of the product club head. After that, in the cutout portion, a stainless steel rod (hosel portion) 23, which was made differently from the composite material, was welded to the stainless steel 13 of the composite material on the welding line 24, that is, welding of the same metals was conducted. At the same time, a cutout portion of one end of the pure titanium 12 side of the composite material member was joined to the stainless steel rod 23 in the hosel section by solder at the joint section 25. Then the above intermediate material member was polished to a product shape. After that, a shaft was attached to the hosel section and, further, a grip was attached to the shaft, and furthermore a metal of high specific gravity was arranged in the hosel section. In this way, a cavity type long iron, referred to as a No. 2 iron, the moment of inertia of which was high, was manufactured.

The durability test of the neck section was conducted on this golf club by a tester. Balls were hit 6000 times at the center of gravity of this golf club head at the speed of 43 m/sec. Also, balls were hit 1000 times at a position distant from the center of gravity of this golf club head by 15 mm to the toe side at the speed of 43 m/sec, and also balls were hit 1000 times at a position distant from the center of gravity by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

When the pure titanium 12 of the composite material member and the stainless steel rod 23 of the hosel section are bonded to each other, joining can be conducted more perfectly as follows. A cutout portion, the depth of which corresponds to the thickness of the pure titanium 12, is formed in the stainless steel rod 23, and the titanium 12 is incorporated into the cutout portion of the stainless steel, and then solder made of silver is applied to the bonding 25. In the same manner as that of Examples 5 and 6, metal of high specific gravity is arranged on the sole side.

Example 10

Figure 11:
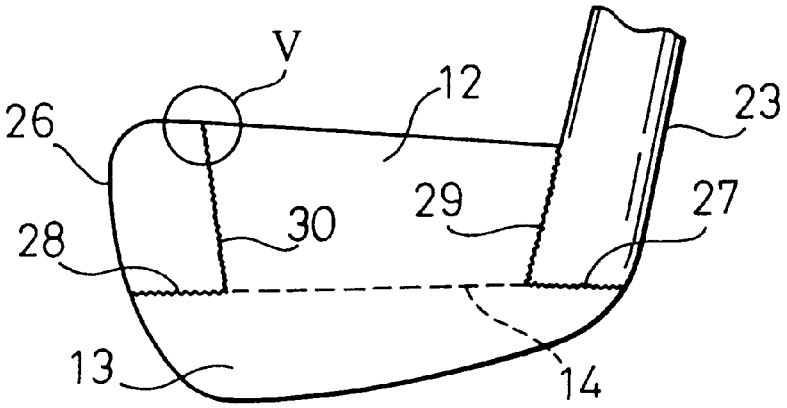
FIG. 11 is a structural view of the iron club head of Example 10 of the present invention.

In FIG. 11, an intermediate composite material block was formed into a club head as follows. In this case, the intermediate composite material block was the same composite material block of Example 5. That is, the overall width was 55 mm, the width of the pure titanium was 40 mm, and the width of the stainless steel was 15 mm, wherein the method of explosive-welding was applied to form the composite material block. Portions of both ends of the composite material block were cut out, and the composite material block was roughly machined into the shape of the product club head. After that, the stainless steel rod 23 was welded to the cutout portion on the hosel attaching side on the welding line 27, and the stainless steel 26 was welded to the cutout portion at the toe position on the opposite side on the welding line 28, that is, the stainless steel rod 23 and the stainless steel 26 were welded to the stainless steel 13 of the composite material block so that the same metals were welded. At the same time, the pure titanium 12 of the composite material block was brazed to the stainless steel rod 23 in the hosel section by solder made of silver at the joint 29. After that, the pure titanium 12 of the composite material block was brazed to the stainless steel plate 13 in the toe section by solder made of silver at the joint 30. Then the intermediate composite material block was polished to a product shape. After that, a shaft was attached to the hosel section 23 and, further, a grip was attached to the shaft, and furthermore pieces of metal of high specific gravity were arranged in the hosel section 23 and the toe section 26. In this way, a cavity type long iron, referred to as a No. 2 iron, the moment of inertia of which was high, was produced.

The durability test of the neck section was conducted on this golf club by a tester. Balls were hit 6000 times at the center of gravity of this golf club head at the speed of 43 m/sec. Also, balls were hit 1000 times at a position distant from the center of gravity of this golf club head by 15 mm to the toe side at the speed of 43 m/sec, and also balls were hit 1000 times at a position distant from the center of gravity by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

Figure 12:
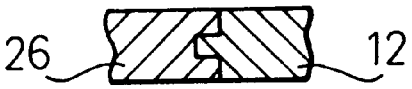
FIG. 12 is an enlarged cross-sectional view of portion A in FIG. 11.

In this connection, FIG. 12 is a cross-sectional view of portion A shown in FIG. 11. A cutout portion is formed in the piece of stainless steel in the toe section, and a protrusion formed in the piece of pure titanium 12 of the composite material block is incorporated into the cutout portion of the piece of stainless steel in the toe section, and the protrusion and the cutout portion are brazed to each other by solder. In this way, the joining strength can be enhanced. The above structure can be applied to other joining sections of the present invention.

Example 11

Figure 13:
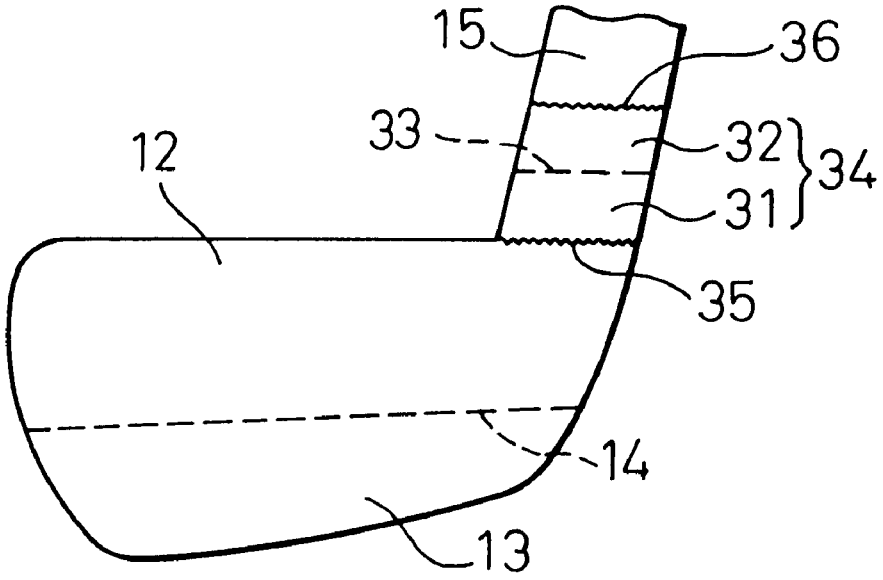
FIG. 13 is a structural view of the iron club head of Example 11 of the present invention.

FIG. 13 is a view showing an example of the club head composed as follows. A material block made of composite material was prepared, the overall width of which was 55 mm. This material block was composed of a piece of titanium 40 mm thick and a piece of stainless steel 15 mm thick by the method of explosive-welding. After this material block had been roughly machined into a product shape (intermediate material), a titanium surface 31 of a composite contact piece 34, which was previously made of a piece of pure titanium 31 and a piece of stainless steel 32 by the method of explosive-welding, was arranged at one end (hosel section) of the piece of pure titanium 12 which had already been machined into the product shape, and TIG welding and plasma arc welding, in which a U-shaped groove was formed, were conducted at a position of the joint 35. Further, a stainless steel rod 15 was welded to the piece of stainless steel 32 at a position of the joint 36, so that the moment of inertia of the club head could be enhanced.

A cavity type long iron head referred to as a No. 3 iron was produced by the above method, and a shaft was attached to the club head, and then a grip was attached to the shaft. The durability test of the neck section was conducted on this golf club by a tester. Balls were hit 6000 times at the center of gravity of this golf club head at the speed of 43 m/sec. Also, balls were hit 1000 times at a position distant from the center of gravity of this golf club head by 15 mm to the toe side at the speed of 43 m/sec, and also balls were hit 1000 times at a position distant from the center of gravity by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

Example 12

FIG. 14 is a view showing an example of the club head composed as follows. A material block made of composite material was prepared, the overall width of which was 55 mm. This material block was composed of a piece of titanium 40 mm thick and a piece of stainless steel of 15 mm thick by the method of explosive-welding. After this material block had been machined into an intermediate material shape in which a hosel section 15 (21, 23) was formed, a hole, the diameter of which was 8.5 mm and the depth of which was a predetermined value, was formed in the hosel attaching section by a drill, and then a stainless steel rod 37, which was previously made, was inserted into the hole. After that the intermediate material was finished into a product shape by polishing. The stainless steel rod 37 was inserted into and fixed to a shaft, and a grip was attached to the shaft. In this way, a cavity type long iron having an over hosel structure usually referred to as a No. 2 iron was produced. The durability test of the neck section was conducted on this golf club by a tester. Balls were hit 6000 times at the center of gravity of this golf club head at the speed of 43 m/sec. Also, balls were hit 1000 times at a position distant from the center of gravity of this golf club head by 15 mm to the toe side at the speed of 43 m/sec, and also balls were hit 1000 times at a position distant from the center of gravity by 15 mm to the heel side at the speed of 43 m/sec. As a result, the golf club passed the test. In order to check the interface on which the different metals were bonded to each other, this club head was tested according to the method of non-destructive inspection including the method of dye penetrant test stipulated by JIS Z2343 and the method of ultrasonic test stipulated by JIS Z2344. As a result of the tests, no defects were found.

Industrial Applicability

As described above, in the golf club head of the present invention, a composite material is made of a metal of high specific gravity and a low specific gravity metal, and the high specific gravity metal is arranged on the sole side and the low specific gravity metal is arranged at a primary portion of the club head, so that the center of gravity of the club head can be lowered and a range in which the sweet spot is located can be extended as the size of the face is increased. When the high specific gravity metal is arranged in the hosel section, the moment of inertia can be further enhanced. Therefore, it is possible for a golfer to hit through by the golf club and also it is possible for a golfer to hit the ball high. Further, it is possible to get distance when the ball is hit by the golf club. Especially, the deterioration of the bonding strength of the bonding portion in which different metals are bonded to each other can be prevented as follows. The method of working is mainly limited to cutting. Alternatively, the primary portion of the club head is previously formed by a low specific gravity metal and welded to a low specific gravity metal of the composite material in which the different metals are bonded to each other. Due to the foregoing, the generation of oxide and nitride on the interface of the bonding of the different metals can be prevented. Therefore, the deterioration of the peel strength on the bonding interface caused by the plastic deformation such as forging can be prevented, and the occurrence of a phenomenon, in which a difference in the plastic deformability caused by the combination of metals having different physical properties is further added to the deterioration of the bonding strength, can be prevented. Due to the foregoing, it becomes possible to provide a handy golf club head, the bonding strength of which is high and also the durability of which is high, and this golf club head can be stably mass-produced.

When a cavity is formed between the low specific gravity metal in the face section and the composite material member composed of the low and high specific gravity metals in the back face section, it is possible to provide a golf club head, and the depth of the center of gravity is large, and further the direction of a ball hit by the golf club head can be stabilized.

We claim:

1. A golf club head comprising: a face section made of a metal of low specific gravity not higher than 5; a back face section made of a clad material in which a metal of low specific gravity and a metal of high specific gravity not lower than 7 are metallurgically bonded to each other in advance, wherein the metal of low specific gravity of the face section and the metal of low specific gravity of the clad material are integrally joined to each other by welding so as to form a club head and a cavity is formed between the face section and the back section.

2. A golf club head according to claim 1, wherein the clad material is composed of a plate-shaped composite material made of metals different from each other which are metallurgically bonded in advance, the plate-shaped composite material is cut and punched to a predetermined size, and the face section and the clad material are integrally bonded to each other by welding so as to form a club head.

3. A golf club head according to claims 1 or 2, wherein the face section and the clad material are cut and polished so as to form a club head after they have been integrally bonded to each other by welding.

4. A golf club head according to claim 1, wherein welding is conducted by means of TIG, plasma arc or laser beams in which a U-shaped and/or V-shaped groove is formed on the surface, to be joined.

5. A golf club head according to any one of claims 1 or 2, wherein, the metal of low specific gravity not higher than 5 contains at least one of titanium, aluminum, magnesium, beryllium, silicon, strontium, vanadium, zirconium, tellurium and antimony, and the residual is inevitable impurities.

6. A golf club head according to claim 1, wherein, the metal of high specific gravity not lower than 7 contains at least one of iron, copper, silver, platinum, gold, niobium, nickel, chromium, manganese, cobalt, molybdenum, tantalum and tungsten, and the residual is inevitable impurities.

7. A method of producing a golf club head according to claim 1, wherein the metallurgical bonding method is an explosive-welding method.

8. A golf club head comprising: a face section made of a metal of low specific gravity not higher than 5; and a back face section, a portion of which is made of a clad material in which a metal of low specific gravity of the same type as that of the face section and a metal of high specific gravity not lower than 7 are metallurgically bonded to each other in advance, wherein the metal of high specific gravity is arranged outside the back face section, the metal of low specific gravity of the face section and the metal of low specific gravity of the composite material of the back face section are integrally bonded to each other so as to form a club head and a cavity is formed between the face section and the back section.

9. A golf club head according to claim 8, wherein the clad material is composed of a plate-shaped composite material made of metals different from each other which are metallurgically bonded in advance, the plate-shaped composite material is cut and punched to a predetermined size, and the face section and the clad material are integrally bonded to each other by welding so as to form a club head, and the clad material are integrally bonded to each other by welding so as to form a club head.

10. A golf club head according to claim 8, wherein the face section and the clad material are cut and polished so as to form a club head after they have been integrally bonded to each other by welding.

11. A golf club head according to claim 8, wherein welding is conducted by means of TIG, plasma arc or laser beams in which a U-shaped and/or V-shaped groove is formed on the surface, to be joined.

12. A golf club head according to claim 8, wherein the metal of low specific gravity not higher than 5 contains at least one of titanium, aluminum, magnesium, beryllium, silicon, strontium, vanadium, zirconium, tellurium and antimony, and the residual is inevitable impurities.

13. A golf club head according to claim 8, wherein the metal of high specific gravity not lower than 7 contains at least one of iron, copper, silver, platinum, gold, niobium, nickel, chromium, manganese, cobalt, molybdenum, tantalum and tungsten, and the residual is inevitable impurities.

14. A method of producing a golf club head according to claim 8, wherein the metallurgical bonding method is an explosive-welding method.

* * * * *

UNITED STATES PATENT AND TRADEMARK OFFICE

CERTIFICATE OF CORRECTION

PATENT NO. : 6,099,414
DATED : August 8, 2000
INVENTOR(S) : Akihiko Kusano, et al It is certified that error appears in the above-identified patent and that said Letters Patent is hereby corrected as shown below:

Front page, [30] under "Foreign Application Priority Data" change "June 27, 1996" to --September 27, 1996-.

Column 13, line 16, between "of" and "was" at beginning of line insert -TIG welding-.

Column 13, line 22, after "surface of" at beginning of line insert -TIG welding-.

Column 18, line 39, change "by" at beginning of line to -with-.

Column 20, line 17, insert a period after "head" and delete "and the clad".

Column 20, line 18, delete entire line.

Column 20, line 19, delete entire line.

Signed and Sealed this

First Day of May, 2001

*Attest:*

Nicholas P. Godici

NICHOLAS P. GODICI

*Attesting Officer*

*Acting Director of the United States Patent and Trademark Office*